US008077095B2

(12) United States Patent
Suh et al.

(10) Patent No.: US 8,077,095 B2
(45) Date of Patent: Dec. 13, 2011

(54) MULTI-BAND HIGHLY ISOLATED PLANAR ANTENNAS INTEGRATED WITH FRONT-END MODULES FOR MOBILE APPLICATIONS

(75) Inventors: Seong-youp Suh, San Jose, CA (US); Vijay K. Nair, Mesa, AZ (US); Debabani Choudhury, Thousand Oaks, CA (US)

(73) Assignee: Intel Corporation, Santa Clara, CA (US)

( * ) Notice: Subject to any disclaimer, the term of this patent is extended or adjusted under 35 U.S.C. 154(b) by 955 days.

(21) Appl. No.: 11/693,013

(22) Filed: Mar. 29, 2007

(65) Prior Publication Data

US 2008/0238804 A1 Oct. 2, 2008

(51) Int. Cl.
*H01Q 1/24* (2006.01)

(52) U.S. Cl. ..... 343/702; 343/700 MS; 343/767; 343/795

(58) Field of Classification Search ..... 343/767, 343/700 MS, 795, 702, 821; 455/41.2
See application file for complete search history.

(56) References Cited

U.S. PATENT DOCUMENTS

| | | | | |
|---|---|---|---|---|
| 3,818,386 | A * | 6/1974 | Granberry | 333/33 |
| 7,095,372 | B2 * | 8/2006 | Soler Castany et al. | 343/700 MS |
| 7,236,065 | B2 * | 6/2007 | Hyvonen | 333/101 |
| 7,283,793 | B1 * | 10/2007 | McKay | 455/83 |
| 7,477,197 | B2 * | 1/2009 | Zeng et al. | 343/700 MS |
| 2002/0000939 | A1 | 1/2002 | Kaiponen | |
| 2003/0090430 | A1 | 5/2003 | Waltho | |
| 2005/0253664 | A1 | 11/2005 | Hyvonen | |
| 2006/0158378 | A1 | 7/2006 | Pons et al. | |
| 2007/0066345 | A1 * | 3/2007 | Hwang et al. | 455/553.1 |
| 2007/0085754 | A1 * | 4/2007 | Ella et al. | 343/862 |
| 2008/0146150 | A1 * | 6/2008 | Luo et al. | 455/41.2 |
| 2008/0204327 | A1 * | 8/2008 | Lee et al. | 343/700 MS |

FOREIGN PATENT DOCUMENTS

| | | | |
|---|---|---|---|
| DE | 10118742 | A1 | 11/2001 |
| EP | 1515389 | A1 | 3/2005 |
| JP | 06331736 | A | 12/1994 |
| KR | 1020000010302 | A | 2/1994 |
| KR | 1020060094797 | A | 8/2006 |
| WO | 2008/121723 | A1 | 10/2008 |

OTHER PUBLICATIONS

International Search Report/Written Opinion for PCT Patent Application No. PCT/US2008/058472, Mailed Jul. 31, 2008, pp. 1-13.
International Preliminary Report on Patentability received for PCT Patent Application No. PCT/US2008/058472, mailed on Oct. 8, 2009, pp. 9.
Extended European Search Report received for European Patent Application No. 08744486.5, mailed on Mar. 14, 2011, 7 pages of European search report.

* cited by examiner

*Primary Examiner* — Tan Ho
(74) *Attorney, Agent, or Firm* — Prass LLP

(57) ABSTRACT

An embodiment of the present invention provides an apparatus, comprising a multi-band highly isolated planar antenna directly integrated with a front-end module (FEM).

21 Claims, 4 Drawing Sheets

MULTI-BAND HIGHLY ISOLATED PLANAR ANTENNAS INTEGRATED WITH FRONT-END MODULES FOR MOBILE APPLICATIONS

BACKGROUND

Conventional antenna systems in devices such as laptop computers may be connected to front-end modules through long RF cable which introduce noise and power loss. As a result, throughput and range of the mobile computer are significantly degraded. These RF cables increase bill of materials (BOM) cost as well. In addition to these problems, there are interferences between multiple antennas in the mobile devices. In future mobile devices, severe interference between multiple radios are expected to occur.

Thus, a strong need exists for multi-band highly isolated planar antennas integrated with front-end module for mobile applications

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
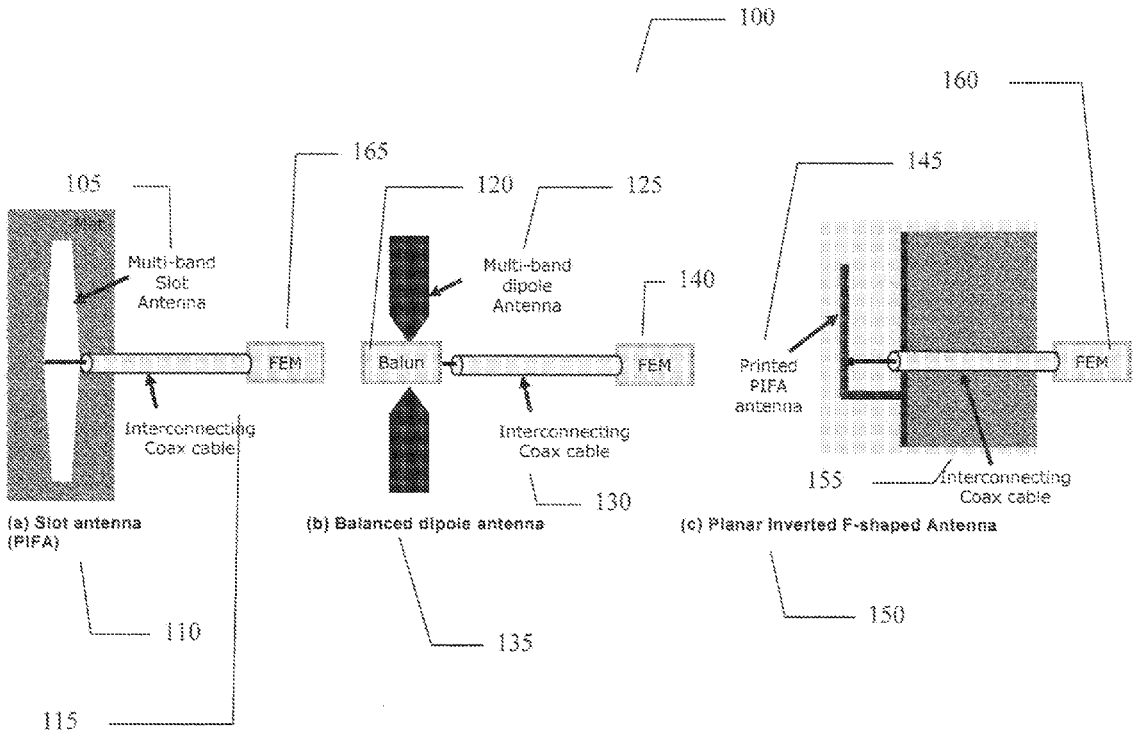
FIG. 1 illustrates an antenna and FEM (Front end module) interconnection in an embodiment of the present invention.

It will be appreciated that for simplicity and clarity of illustration, elements illustrated in the figures have not necessarily been drawn to scale. For example, the dimensions of some of the elements are exaggerated relative to other elements for clarity. Further, where considered appropriate, reference numerals have been repeated among the figures to indicate corresponding or analogous elements.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, units and/or circuits have not been described in detail so as not to obscure the invention.

Embodiments of the invention may be used in a variety of applications. Some embodiments of the invention may be used in conjunction with various devices and systems, for example, a transmitter, a receiver, a transceiver, a transmitter-receiver, a wireless communication station, a wireless communication device, a wireless Access Point (AP), a modem, a wireless modem, a Personal Computer (PC), a desktop computer, a mobile computer, a laptop computer, a notebook computer, a tablet computer, a server computer, a handheld computer, a handheld device, a Personal Digital Assistant (PDA) device, a handheld PDA device, a network, a wireless network, a Local Area Network (LAN), a Wireless LAN (WLAN), a Metropolitan Area Network (MAN), a Wireless MAN (WMAN), a Wide Area Network (WAN), a Wireless WAN (WWAN), devices and/or networks operating in accordance with existing IEEE 802.11, 802.11a, 802.11b, 802.11e, 802.11g, 802.11h, 802.11i, 802.11n, 802.16, 802.16d, 802.16e standards and/or future versions and/or derivatives and/or Long Term Evolution (LTE) of the above standards, a Personal Area Network (PAN), a Wireless PAN (WPAN), units and/or devices which are part of the above WLAN and/or PAN and/or WPAN networks, one way and/or two-way radio communication systems, cellular radio-telephone communication systems, a cellular telephone, a wireless telephone, a Personal Communication Systems (PCS) device, a PDA device which incorporates a wireless communication device, a Multiple Input Multiple Output (MIMO) transceiver or device, a Single Input Multiple Output (SIMO) transceiver or device, a Multiple Input Single Output (MISO) transceiver or device, a Multi Receiver Chain (MRC) transceiver or device, a transceiver or device having "smart antenna" technology or multiple antenna technology, or the like. Some embodiments of the invention may be used in conjunction with one or more types of wireless communication signals and/or systems, for example, Radio Frequency (RF), Infra Red (IR), Frequency-Division Multiplexing (FDM), Orthogonal FDM (OFDM), Time-Division Multiplexing (TDM), Time-Division Multiple Access (TDMA), Extended TDMA (E-TDMA), General Packet Radio Service (GPRS), Extended GPRS, Code-Division Multiple Access (CDMA), Wideband CDMA (WCDMA), CDMA 2000, Multi-Carrier Modulation (MDM), Discrete Multi-Tone (DMT), Bluetooth®, ZigBee™, or the like. Embodiments of the invention may be used in various other apparatuses, devices, systems and/or networks.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations.

Although embodiments of the invention are not limited in this regard, the term "multicast/broadcast" as used herein may include, for example, multicast communication, broadcast communication, wireless multicast communication, wired multicast communication, wireless broadcast communication, wired broadcast communication, multicast communication over the Internet or over a global communication network, broadcast communication over the Internet or over a global communication network, multicast communication using TCP/IP, broadcast communication using TCP/IP, webcast communication (e.g., using the World Wide Web), and/or other types of communication, e.g., non-unicast communication.

An embodiment of the present invention provides the integration of highly isolated multi-band antennas and front-end module (FEM) for multi-radio platforms. Conventional antenna systems, in laptop computers for example, may be connected to front-end modules through long RF cable which introduces noise and power loss. As a result, throughput and range of the mobile computer are significantly degraded. As mentioned above, these RF cables increase BOM cost as well. In addition to these problems, there are interferences between multiple antennas in the mobile devices. Highly isolated antenna combinations have been developed to mitigate the interference problems.

One such antenna configurations in provided in FIG. 1 at 100 and depicts multi-band slot antenna 105 in a slot shaped antenna 110 connected to FEM 165 via interconnecting cables 115. At 135 is a balanced dipole antenna, which may be multi-band dipole antenna 125, is connected via balun 120 and interconnect coax cable 130 to FEM 140. At 150 is a planar inverted F antenna which may be a printed PIFA antenna 145 connected to FEM 160 via interconnecting coax cable 155. These types of antennas demonstrated very good antenna isolation even they were located in close proximity. However, the highly isolated antennas 110, 135 and 150 still uses conventional interconnection with FEM 165, 140 and 160 using typical coax cables 115, 130 and 155.

Figure 2:
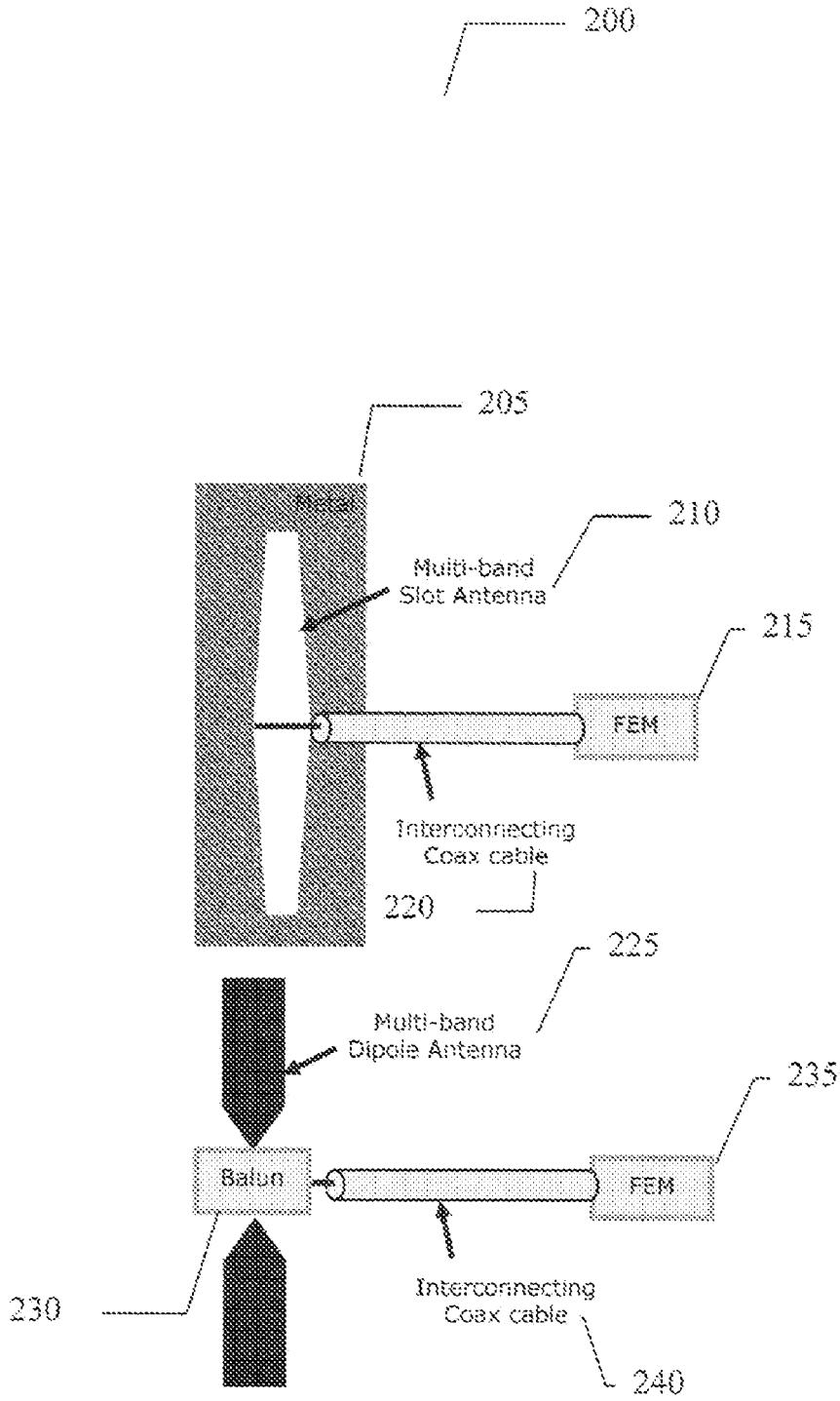
FIG. 2 illustrates a vertically configured high isolation antenna pair in an embodiment of the present invention.
Figure 3:
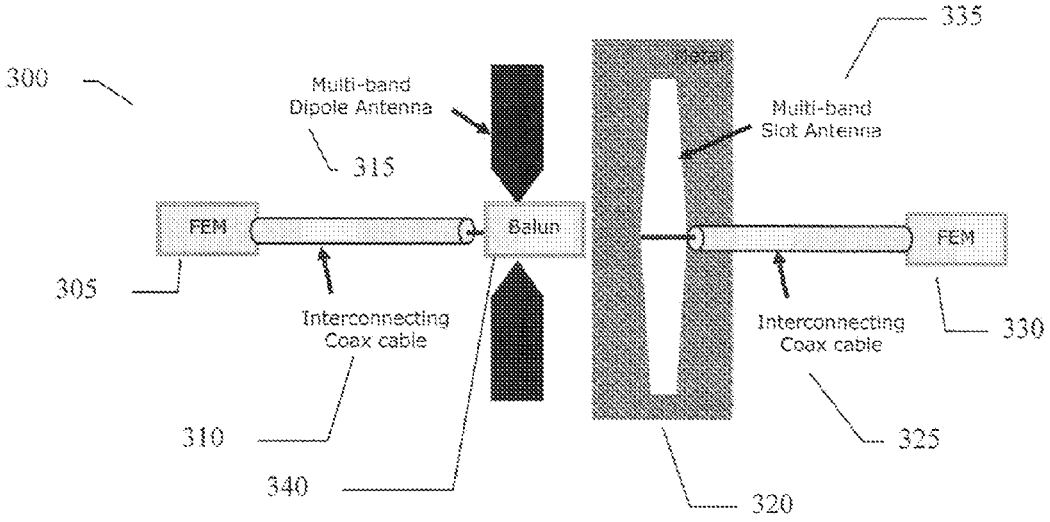
FIG. 3 shows a horizontally configured high isolation antenna pair in an embodiment of the present invention.

Looking now at FIG. 2 and FIG. 3 are a vertically configured high isolation antenna pair 200 and a horizontally configured high isolation antenna pair 300. FIG. 2 illustrates metal 205 with multi-band slot antenna 210 connected to FEM via interconnecting coax cable 220. At 225 multi-band dipole antenna 225 is connected to balun 230 and FEM 235 via interconnecting coax cable 240.

FIG. 3 illustrates multi-band slot antenna 335 etched from metal 320 connected to FEM 330 via interconnecting coax cable 325. Further, multi-band dipole antenna 315 is connected via balun 340 and interconnecting coax cable 310 to FEM 305. Again, these types of antennas demonstrate very good antenna isolation even they were located in close proximity. As with the antenna of FIG. 1, more than 40 dB antenna isolation in 10 mm separation have been demonstrated and dramatically improved data throughput has also been shown relative to a conventional antenna system under the same environment and conditions.

Figure 4:
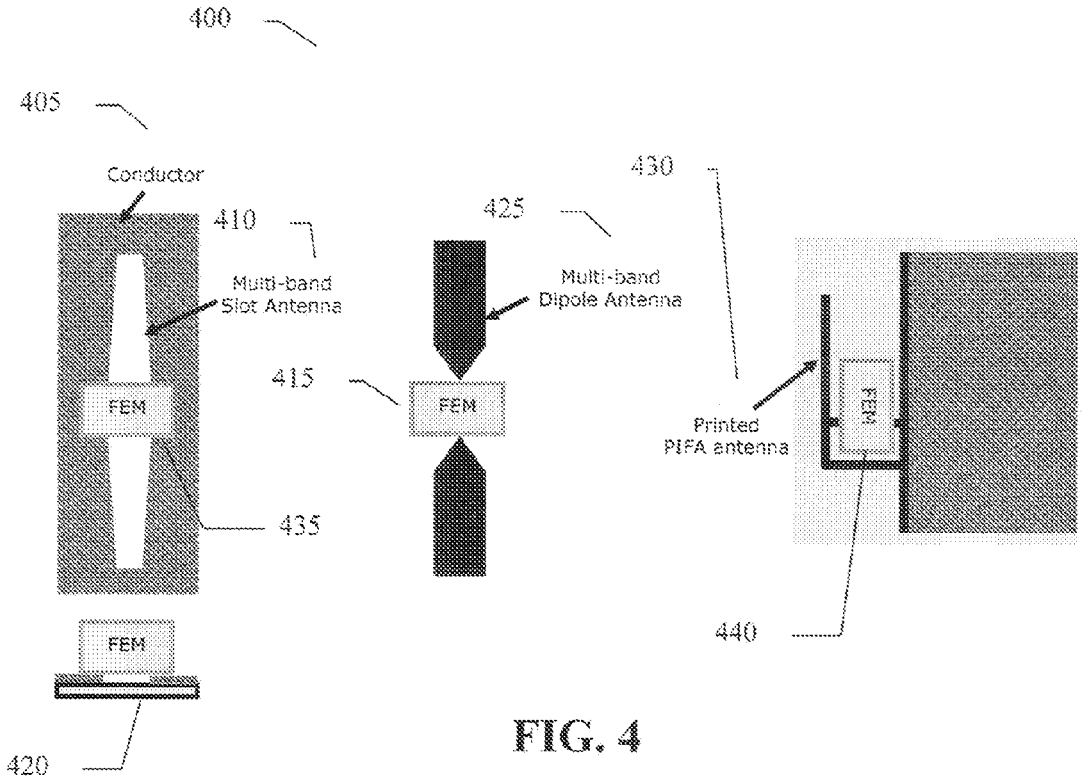
FIG. 4 depicts a three FEM-integrated wireless antenna topologies in an embodiment of the present invention.

In an embodiment of the present invention is provided the integration of the FEMs within the antenna element and the integration of high-isolation antenna pairs with the FEM. FIG. 4 shows three different antennas which are integrated with FEMS 435, 415 and 440; slot antenna 410, balanced dipole antenna 425, and PIFA (Planar Inverted F-shaped Antenna) antennas 430. These are only a few examples of wireless antennas and it is understood that the present invention is not limited to these types of antennas. Many other variations/types of antennas can be integrated with similar approach. In one embodiment of the present invention, FEMs 435, 415 and 440 may be integrated between excitation ports in each antenna. The physical dimension of the FEMs 435, 415 and 440 may be included in antenna design to account for the parasitic effect of the FEMs 435, 415 and 440 on antenna radiation performance.

Figure 5:
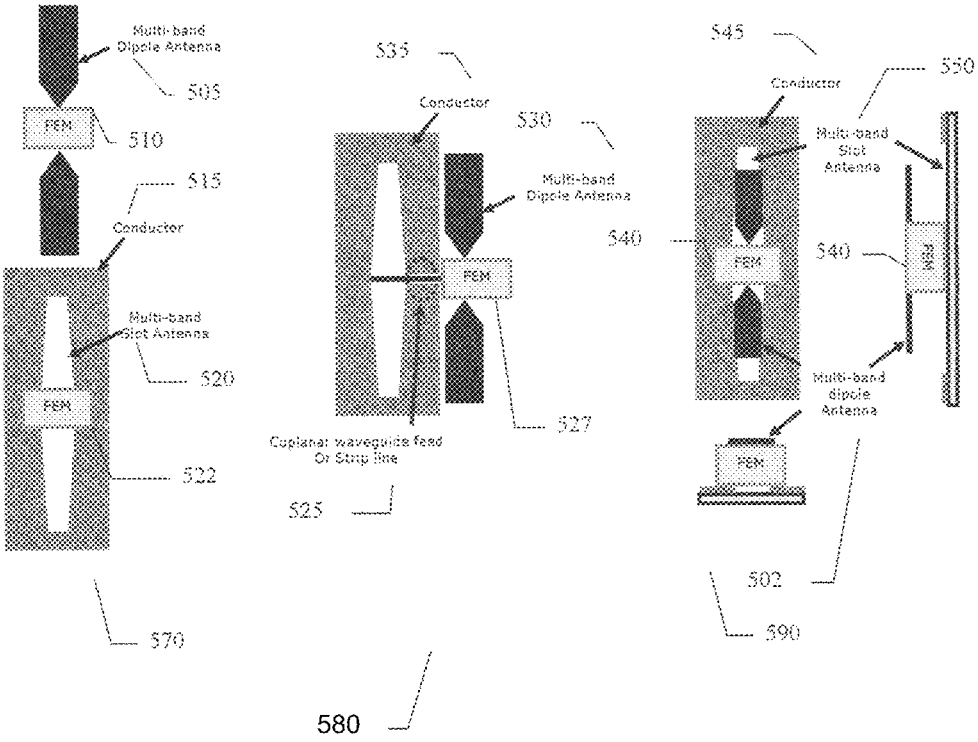
FIG. 5 depicts a high isolation antenna with FEM integration with three different configurations in embodiment of the present invention.

Shown in FIG. 5 are some embodiments of the present invention which illustrate implementation schemes of closely spaced highly isolated complementary antenna pairs with FEMs. FIG. 5 at 570 is the vertically-configured complementary antenna pair 520 and 505 fed to two FEMs 510 and 522 separately, (which is a combination of dipole 505 and slot 520 antennas to have high isolation). Another configuration of the high isolation antenna is shown at 580 sharing one multi-radio FEM 527 simultaneously. FIG. 5 at 580 is the side-by-side antenna 535 configuration sharing FEM 527 through printed coplanar waveguide 525 or strip line with multi-band dipole antenna 530. FIG. 5 at 590 is the top-to-bottom configuration, in which the FEMs 540 is located in-between two antennas. Slot antenna 550 is fed from the bottom section of FEM 540 and electric dipole antenna 502 is connected to the top of the FEM 540. All three different configurations provide very high isolation because of the orthogonal polarization property and different radiation mode of the antennas. Although not limited in this respect, we can select one of the three configurations depending on the antenna pattern requirements because each configuration provides three different radiation patterns.

Some embodiments of the invention may be implemented by software, by hardware, or by any combination of software and/or hardware as may be suitable for specific applications or in accordance with specific design requirements. Embodiments of the invention may include units and/or sub-units, which may be separate of each other or combined together, in whole or in part, and may be implemented using specific, multi-purpose or general processors or controllers, or devices as are known in the art. Some embodiments of the invention may include buffers, registers, stacks, storage units and/or memory units, for temporary or long-term storage of data or in order to facilitate the operation of a specific embodiment.

Some embodiments of the invention may be implemented, for example, using a machine-readable medium or article which may store an instruction or a set of instructions that, if executed by a machine, for example, by a system, by a station, by a processor or by other suitable machines, cause the machine to perform a method and/or operations in accordance with embodiments of the invention. Such machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Re-Writeable (CD-RW), optical disk, magnetic media, various types of Digital Versatile Disks (DVDs), a tape, a cassette, or the like. The instructions may include any suitable type of code, for example, source code, compiled code, interpreted code, executable code, static code, dynamic code, or the like, and may be implemented using any suitable high-level, low-level, object-oriented, visual, compiled and/or interpreted programming language, e.g., C, C++, Java, BASIC, Pascal, Fortran, Cobol, assembly language, machine code, or the like.

Embodiments of the present invention may provide a machine-accessible medium that provides instructions, which when accessed, cause a machine to perform operations comprising integrating a multi-band highly isolated planar antenna directly with a front-end module (FEM). In a further embodiment of the present invention, the machine-accessible medium may further comprise further instructions, which when accessed, cause a machine to perform operations further comprising designing said antenna and said FEM with matched impedance and designing a balun in the FEM and directly connected with said antenna.

A further embodiment of the present invention provides a system, comprising a multi-band highly isolated planar antenna and an a front-end module (FEM) directly integrated with said antenna.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

We claim:

1. An apparatus, comprising:

closely spaced highly isolated complementary antenna pairs directly integrated with a front-end module (FEM), wherein the complementary antenna pairs can be arranged into different antenna configurations; and wherein said FEM is integrated between an excitation port of a first complementary antenna pair and an excitation port of a second complementary antenna pair and physical dimensions of said FEM are included in antenna design to account for a parasitic effect caused by said FEM on antenna radiation performance.

2. The apparatus of claim 1, wherein said front-end module is operable in for mobile applications.

3. The apparatus of claim 1, wherein said complementary antenna pairs and said FEM are designed with matched impedance.

4. The apparatus of claim 1, further comprising a balun designed in the FEM and directly connected with said complementary antenna pairs.

5. The apparatus of claim 1, wherein each of the antenna pairs is selected from at least the group consisting of:

(1) slot antenna;

(2) dipole antenna; and (3) planar inverted F-shaped antenna.

6. The apparatus of claim 1, wherein an antenna configuration is selected from at least the group consisting of:

vertical configuration;

side-by-side configuration; and top-to-bottom configuration.

7. A method, comprising:

integrating closely spaced highly isolated complementary antenna pairs directly with a front-end module (FEM), wherein the complementary antenna pairs can be arranged into different antenna configurations; and wherein said FEM is integrated between an excitation port of a first complementary antenna pair and an excitation port of a second complementary antenna pair and physical dimensions of said FEM are included in antenna design to account for a parasitic effect caused by said FEM on antenna radiation performance.

8. The method of claim 7, wherein said front-end module is operable in for mobile applications.

9. The method of claim 7, further comprising designing said complementary antenna pairs and said FEM with matched impedance.

10. The method of claim 7, further comprising designing a balun in the FEM and directly connected with said complementary antenna pairs.

11. The method of claim 7, further comprising selecting each of the antenna pairs from at least the group consisting of:

(1) slot antenna;

(2) dipole antenna; and (3) planar inverted F-shaped antenna.

12. The method of claim 7, further comprising selecting an antenna configuration from at least the group consisting of:

vertical configuration;

side-by-side configuration; and top-to-bottom configuration.

13. A machine-accessible medium that provides instructions, which when accessed, cause a machine to perform operations comprising:

integrating closely spaced highly isolated complementary antenna pairs directly with a front-end module (FEM), wherein the complementary antenna pairs can be arranged into different antenna configurations ; and wherein said FEM is integrated between an excitation port of a first complementary antenna pair and an excitation port of a second complementary antenna pair and physical dimensions of said FEM are included in antenna design to account for a parasitic effect caused by said FEM on antenna radiation performance.

14. The machine-accessible medium of claim 13, further comprising further instructions, which when accessed, cause a machine to perform operations further comprising designing said complementary antenna pairs and said FEM with matched impedance.

15. The machine-accessible medium of claim 13, further comprising further instructions, which when accessed, cause a machine to perform operations further comprising designing a balun in the FEM and directly connected with said complementary antenna pairs.

16. A system, comprising:

closely spaced highly isolated complementary antenna pairs, wherein the complementary antenna pairs can be arranged into different antenna configurations;

a front-end module (FEM) directly integrated with said antenna complementary antenna pairs; and wherein said FEM is integrated between an excitation port of a first complementary antenna pair and an excitation port of a second complementary antenna pair and physical dimensions of said FEM are included in antenna design to account for a parasitic effect caused by said FEM on antenna radiation performance.

17. The system of claim 16, wherein said front-end module is operable in for mobile applications.

18. The system of claim 16, wherein said antenna and said FEM are designed with matched impedance.

19. The system of claim 16, further comprising a balun designed in the FEM and directly connected with said complementary antenna pairs.

20. The system of claim 16, wherein each of the antenna pairs is selected from at least the group consisting of:

(1) slot antenna;

(2) dipole antenna; and (3) planar inverted F-shaped antenna.

21. The system of claim 16, wherein an antenna configuration is selected from at least the group consisting of:

vertical configuration;

side-by-side configuration; and top-to-bottom configuration.

* * * * *